US008175312B1

(12) United States Patent
Bezdek et al.

(10) Patent No.: US 8,175,312 B1
(45) Date of Patent: May 8, 2012

(54) DIRECTIONAL SOUND PROJECTION SYSTEM

(76) Inventors: Jeff M. Bezdek, Oklahoma City, OK (US); Jonathan Mooneyham, Oklahoma City, OK (US); Stan Carroll, Oklahoma City, OK (US); Chris Johnson, Jones, OK (US)

( * ) Notice: Subject to any disclaimer, the term of this patent is extended or adjusted under 35 U.S.C. 154(b) by 316 days.

(21) Appl. No.: 12/386,031

(22) Filed: Apr. 13, 2009

Related U.S. Application Data

(60) Provisional application No. 61/044,494, filed on Apr. 13, 2008.

(51) Int. Cl.
*H04R 1/02* (2006.01)

(52) U.S. Cl. ..... 381/340; 381/341; 381/342

(58) Field of Classification Search ..... 381/340–342; D14/187, 208
See application file for complete search history.

(56) References Cited

U.S. PATENT DOCUMENTS 3,028,927 A * 4/1962 Levy et al. ..... 381/341
5,266,751 A * 11/1993 Taguchi ..... 181/144

* cited by examiner

*Primary Examiner* — Anh Mai
*Assistant Examiner* — Ronald Hinson
(74) *Attorney, Agent, or Firm* — Martin G. Ozinga; Phillips Murrah PC

(57) ABSTRACT

The present invention essentially comprises a horn separated into a plurality of sections, wherein the horn is supported by a mounting bracket that may be both rotatable and pivotable and wherein the horn is made of two portions wherein the general middle is used as the attachment point to a bracket while both ends are also supported by the bracket.

1 Claim, 2 Drawing Sheets

DIRECTIONAL SOUND PROJECTION SYSTEM

CROSS-REFERENCE TO RELATED APPLICATIONS

Priority is claimed from provisional patent application U.S. Ser. No. 61/044,494, filed on Apr. 13, 2008, and incorporated by reference herein.

BACKGROUND OF THE INVENTION

1. Field of the Invention

This invention relates, in general, to audio speaker systems, and relates more specifically to a horn type audio speaker system that is capable of projecting sound over long distances in a variety of directions.

2. Description of the Known Prior Art

Horn type speakers, or horns, are generally known in the acoustical arts as an intensifying element which is tubular in construction having a cross-sectional area that varies along the element's length. Horns are typically designed to act as a transformer between the voice diaphragm of the compression driver and the atmosphere, and are particularly useful for transmitting a significant amount of acoustical power to a listening area. Thus, in situations with high sound pressure level requirements, like public address, stadium sound, siren/signal amplification, or voice projection, horn type speaker systems are generally employed.

Conventional loudspeakers utilize what is generally referred to as a folded horn, in which a) a crossectional area of the sound conducting element decreases as the distance from the diaphragm increases, or b) the sound path of the element has one or more sharp bends, or c) an entrance of the element is smoothly curved back toward the exit. One problem experienced with prior art folded horn type speakers concerns their characteristically significant distortion. There is a need in the acoustical arts for a sound projection system that significantly decreases the continued reflection and re-reflection of the sound path that can lead to unpleasant standing waves and distortions.

One's normal experience when listening to a PA system is that the sound while intelligible is not pleasing in its reproduction when contrasted, for example, with the high fidelity sound from a conventional home stereo. Conventional horn type speakers introduce significant distortion at certain distances away from, and around, the location of the speaker. Listeners perceive this distortion as a lack of quality and clarity of the sound.

Clarity of the sound production is not only more pleasing to the listener, but in some cases can mean the matter of life and death. In what has become a far too familiar emergency situation, tragedies like the shooting incident at Columbine High School or the massacre at Virginia Tech require clear communication from and between emergency personnel. When students, teachers, or members of law enforcement and rescue teams are faced with life-threatening situations in a campus like setting, the clarity of emergency announcements and instructions can very likely save lives. Prior art devices, such as a conventional PA system, may produce an unintelligible sound that distorts the announcement and results in added confusion. Thus, in situations like these, a need exists for an efficient and clear apparatus, system and method for communicating to a large number of people over long distances.

Moreover, the mounting and location of sound projection systems has a significant effect on the clarity of the sound production. Conventional horn type speakers are typically mounted at stationary positions, making it difficult to adjust for the needs of surrounding listeners. By example, the sound propagating from a horn type speaker that is mounted near the top of a building or structure is only intelligible to those listeners who are in front of the open end of the horn. If the audience of listeners change locations from one event to the next, the direction of a conventionally mounted horn type speaker can be difficult, if not impossible, to adjust for the needs of each event. Furthermore, when a plurality of horn type speakers are concentrated in one location, sounds from one speaker interfere with sounds of another. Such interference results in peaks and dips in the sound pressure level at the location where the horn type speakers are installed. Again, this unstable sound pressure level would cause listeners to feel unpleasant or make the sounds difficult to hear.

It would be advantageous to provide a sound projection system that transmits sound over a long distance with minimal distortion. It would also be advantageous to allow users to easily adjust the direction of the horn type speakers according to the needs of the listeners at each event. It would further be advantageous to provide a horn type speaker that can be fabricated in a more economical and feasible manner, and can be easily attached to an adjustable mounting bracket.

Due to the varied needs and uses, the prior art devices have failed to provide an adequate solution to providing quality sound over a long distance and in a variety of directions. Thus, there is a need for a new and improved horn type speaker and mounting bracket that provides a superior solution where the prior art fails.

BRIEF SUMMARY OF THE INVENTION

In view of the foregoing disadvantages inherent in the known types of apparatus, systems, and methods now present in the acoustical arts, the present invention provides a new and improved horn type speaker and mounting bracket that allows the horn to be constructed in multiple pieces, and adjusted to face a variety of directions. As such, the general purpose of the present invention, which will be described subsequently in greater detail, is to provide a more economical and higher quality sound projection system that has all the advantages of the prior art devices while overcoming the known disadvantages.

To attain this, the present invention essentially comprises a horn separated into a plurality of sections, wherein the horn is supported by a mounting bracket that may be both rotatable and pivotable. In a preferred construction, a horn is made of two portions wherein the general middle is used as the attachment point to a bracket while both ends are also supported to the bracket. It is further contemplated to incorporate a pivotal and rotatable bracket with the construction of a horn to generally form a one piece construction of same.

In this respect, before explaining at least one embodiment of the invention in detail, it is to be understood that the invention is not limited in this application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Accordingly, titles, headings, chapters name, classifications and overall segmentation of the application in general should not be construed as limiting. Such are provided for overall readability and not necessarily as literally defining text or material associated therewith. Further, the purpose of the foregoing discussion of the background and scope of the invention is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. This discussion is neither intended to define the invention of the application, which is measured by the claims, nor is it intended to be limiting as to the scope of the invention in any way. The following stated objects of the invention are alternative and exemplary objects only, and should not be read as required for the practice of the invention, or as an exhaustive listing of objects accomplished.

It is therefore an object of the present invention to provide a sound projection system that is capable of projecting sounds over long distances and can be adjusted to project sound in a variety of directions.

Another further object of the present invention is to provide a new and improved horn type speaker and mounting bracket, which is of a relatively simple design and thus may be easily and efficiently manufactured.

An even further object of the present invention is to provide a new and improved horn type speaker and mounting bracket which is of a more durable and reliable construction and can be more easily adapted for outdoor use than that of the existing known art.

Still another object of the present invention is to provide a new and improved horn type speaker and mounting bracket which is susceptible to a low cost of manufacture with regard to both materials and labor, which accordingly is then susceptible of low prices of sale to the consuming public, thereby making such economically available to those utilizing sound projection systems.

Another object of the present invention is to provide a new and improved horn type speaker and mounting bracket that provides some of the advantages of the prior art, while simultaneously overcoming some of the disadvantages normally associated therewith.

These together with other objects of the invention, along with the various features of novelty, which characterize the invention, are pointed out with particularity in the claims annexed to and forming a part of this disclosure. The above objects and advantages are neither exhaustive nor individually or jointly critical to the spirit or practice of the invention. Other aspects and advantages of the invention will become apparent to those skilled in the art from the following detailed description in combination with the accompanying drawings, illustrating, by way of example, the principles of the invention.

BRIEF DESCRIPTION OF THE SEVERAL VIEWS OF THE DRAWING

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF THE INVENTION

Figure 1:
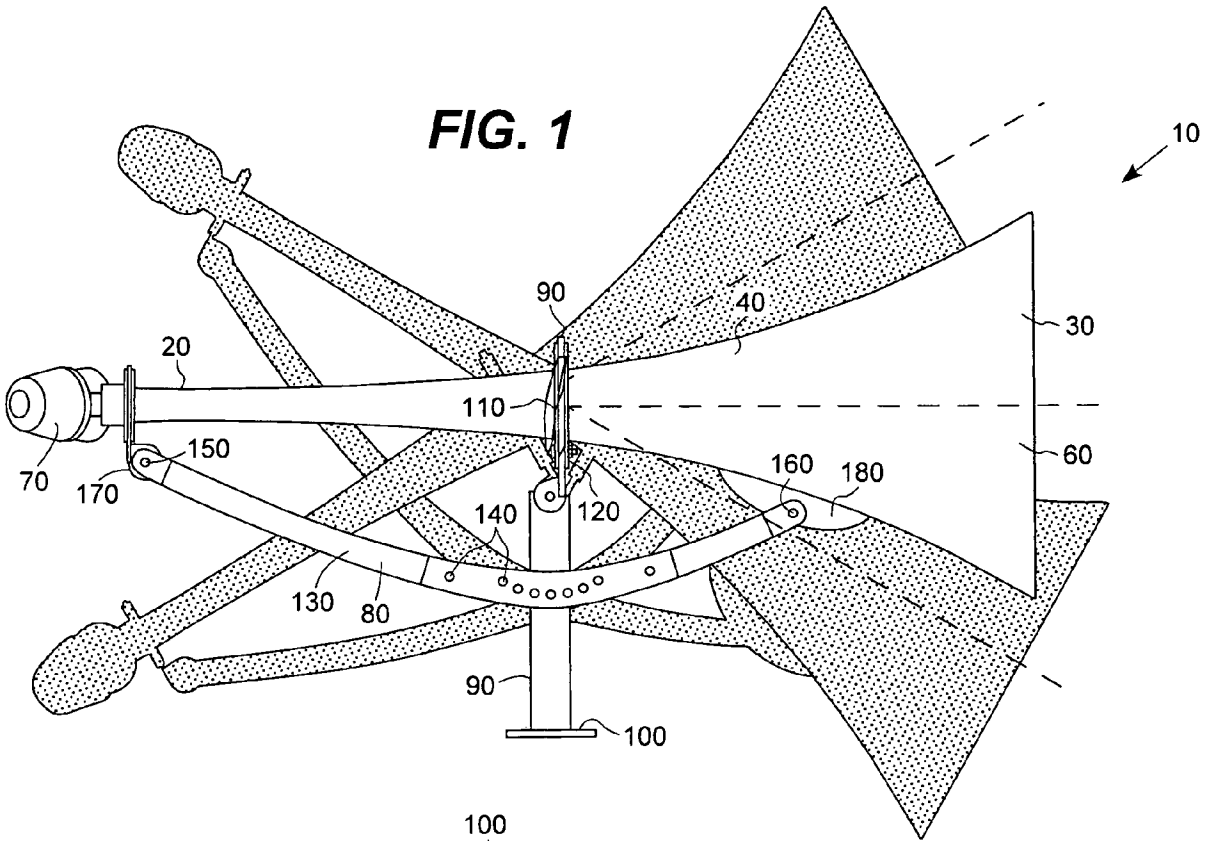
FIG. 1 is a general side elevation view of a preferred embodiment constructed in accordance with the present invention.

Referring to the drawings, illustrations, pictures and attachments and in particular FIG. 1, a directional sound projection system and or apparatus capable of projecting sound over long distances in a variety of directions, constructed in accordance with the present invention 10 is shown. In a preferred construction, a horn first piece 20 and a horn second piece 30 are supported and joined to form a single-axis horn 40 by a mounting bracket 50. It should be understood, however, that invention 10 may consist of a plurality of horn pieces, and is not limited in construction to only a first piece and a second piece. For discussion purposes, two exemplary horn pieces are described: the horn first piece 20 adapted for introducing the sound wave (generally referred to as the "throat"), and the horn second piece 30 adapted for further propagation and release of the sound wave from the sound projection system 60 (generally referred to as the "mouth").

In a preferred embodiment, the horn first piece 20 and horn second piece 30 may be die-cast or molded of a semi-rigid material, such as a high density polyester-fiberglass thermoset composite, metal, polystyrene foam, a combination thereof, or other moldable materials generally known to those skilled in the art. It will be appreciated that the material contemplated for the horn first piece 20 and horn second piece 30 should be conducive for sound propagation, and may not be limited in any other respect.

The horn first piece 20 and horn second piece 30 may each be tubular in construction, as shown, both having a cross-sectional area that varies along the element's length. The horn first piece 20 and horn second piece 30 may be designed to confine and direct the propagation of modulated air pressure (i.e., acoustic waves) in a longitudinal direction. In operation, the acoustic wave enters the horn first piece 20 by means of a driving element 70 (i.e., compression driver transducer), and exits the horn second piece 30 to the ambient air. To achieve long range projection of the acoustic wave, the inside wall, or air column, of the horn first piece 20 and horn second piece 30 may be designed to have a smooth surface, with minimal penetrations, fissures or gaps.

It is appreciated that while the horn first piece 20 and horn second piece 30 are shown to be tubular in construction, it is contemplated that the horn first piece 20 and horn second piece 30 may be of any shape, such as rectangular in cross-section, square, oval, or combinations thereof.

Figure 2:
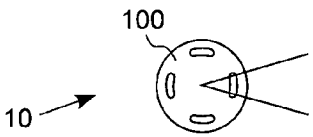
FIG. 2 is a general bottom view of a preferred embodiment of a mounting bracket constructed in accordance with the present invention.
Figure 3:
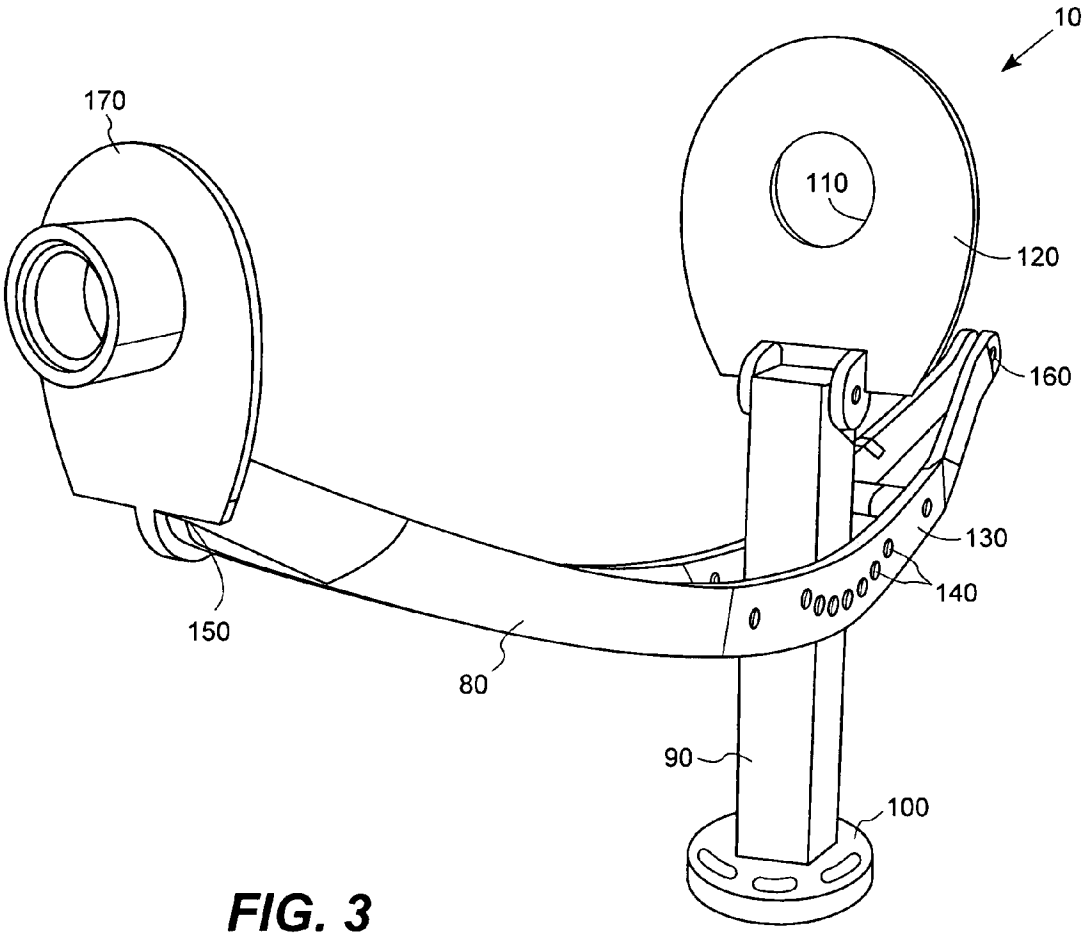
FIG. 3 is a general perspective view of a preferred embodiment constructed in accordance with the present invention.

Now, referring to the drawings again and also more particularly to FIGS. 2 and 3, the mounting bracket 50 is shown to include a connection bracket 80 for connecting the horn first piece 20 and horn second piece 30 along a single-axis, a support member 90 pivotably attached to the connection bracket 80, and a support bracket 100 to form a rotatable connection to the mounting surface. The mounting bracket 50 is particularly useful in allowing the horn 40 to be pivoted and rotated with minimal ease and effort. While the means for pivoting and rotating the horn 40 are shown to be mechanical herein, it should be understood that such configuration may be accommodated electronically as well.

The connection bracket 80 is shown to be generally circular in cross-sectional construction to accommodate the shape of the horn first piece 20 and horn second piece 30, and shown to have an interior opening 110 formed of a flange 120. The opening 110 may vary in diameter to achieve the object of having an interior air column with minimal penetrations, fissures or gaps. The flange 120 portion of the connection bracket 80 may likewise vary to function as a solid connection between the horn first piece 20 and the horn second piece 30. Furthermore, the connection bracket 80 includes means for pivotably attaching to the support member 90. Such means may include, but are not limited to, a pin/slot, a nut/bolt, or a compression connection.

The support member 90 shown to be pivotably attached to the connection bracket 80 may be designed to assist in supporting the weight or balancing the horn 40. In addition to including means for pivoting the horn 40, the support member 90 is also designed to attach or include the support bracket 100 which allows invention 10 to be rotated up to 360 degrees relative to the mounting surface. The support member 90 further includes means for stabilizing a swing arm 130 of the present invention.

The swing arm 130 is shown to have a general arc shape extending the length of the horn 40, and is shown to include a plurality of holes 140 along the arc for connection with the support member 90. However, while the swing arm 130 is shown to have a general arc shape, it will be appreciated that the swing arm 130 may assume other shapes and lengths, as the general shape and length of the swing arm 130 is may not be critical to the function and purpose of invention 10. Furthermore, the illustrated means for stabilizing the swing arm 130 should not be limited to that shown. Such means may include a variety of connections known to those skilled in the art.

The swing arm 130 further includes a first end 150 and a second end 160, wherein the first end 150 of the swing arm 130 is attached to a driver connection bracket 170 near the entrance of the horn first piece 20, and the second end 160 of the swing arm 130 is attached to an extended portion 180 of the horn second piece 30. The first end 150 and second end 160 of the swing arm 130 may each be designed to pivot in relation to the horn 40 and support member 90.

As described above, the driver connection bracket 170 is shown to be pivotably attached to the first end 150 of the swing arm 130, connected to the horn first piece 20, and connected to the driving element 70. It is contemplated, however, that the driving element 70 may be directly attached to the horn first piece 20, thereby making the driver connection bracket 170 unnecessary or entirely different in shape, form and structure.

From the above description it is clear that present invention 10 is well adapted to carry out the objects and to attain the advantages mentioned herein as well as those inherent in the invention. While presently preferred embodiments of the invention have been described for purposes of disclosure, it will be understood that numerous changes may be made which readily suggest themselves to those skilled in the art and which are accomplished within the spirit of the invention disclosed.

What is claimed is:

1. An adjustably mountable horn loudspeaker assembly for projecting sound over long distances comprising:

a first horn piece having a first end, a throat, and a second end;

a second horn piece having a first end and a mouth;

a bracket assembly for supporting and joining said horn first piece and said second horn piece to form a single-axis horn comprising:

driver connection bracket for connecting a driving element to said first end of said first horn piece;

a swing arm having a first end and a second end wherein said first end is connected to said driver connection bracket and said second end is connected to said second horn piece;

a flange having an aperture and wherein said flange connects said first horn piece second end to said horn second piece first; and a rotatable support member pivotally attached to said flange.

* * * * *